US006095170A

United States Patent [19]

Wang

[11] Patent Number: 6,095,170

[45] Date of Patent: Aug. 1, 2000

[54] AUTOMATICALLY SPREADING AND COLLAPSING UMBRELLA

[76] Inventor: Max Wang, No. 19, Ta-Yuan 13th St., Tai-Ping City, Taichung Hsien, Taiwan

[21] Appl. No.: 09/233,568

[22] Filed: Jan. 19, 1999

[51] Int. Cl.[7] ..... A45B 25/00

[52] U.S. Cl. ..... 135/31; 135/29; 135/32

[58] Field of Search ..... 135/15.1, 29, 31, 135/32

[56] References Cited

U.S. PATENT DOCUMENTS

| | | | |
|---|---|---|---|
| 4,658,844 | 4/1987 | Ping | 135/25.3 |
| 5,337,770 | 8/1994 | Wang | 135/25.3 |
| 5,553,634 | 9/1996 | Yang | 135/25.3 |
| 5,645,094 | 7/1997 | Wu | 135/24 |
| 5,964,235 | 10/1999 | Wang | 135/28 |

*Primary Examiner*—Beth A. Stephan

*Attorney, Agent, or Firm*—Ladas & Parry

[57] ABSTRACT

An automatically spreading and collapsing umbrella includes a plurality of rib assemblies pivoted to a ferrule on a handle, and a plurality of stretcher assemblies. Each stretcher assembly is pivoted to a runner slidably sleeved on the handle to stretch or retract a respective rib assembly when the runner is moved. An anchored member has two ends journalled on a main rib of one of the rib assemblies, and a middle portion having an anchored site which is formed as a bent strip that is vaulted upwardly. A collapsing tension spring is retained between a connecting rod of one of the stretcher assemblies and the anchored site so as to define a collapsing line along an extending length of the spring. Stretching of the rib assemblies can extend the spring to store an elastic potential energy to facilitate collapsing of the rib assemblies. A resilient wire is connected to one end of the anchored member and an extending rib of one of the rib assemblies so as to actuate the extending rib to retract inwardly toward the handle when the rib assemblies are collapsed.

2 Claims, 8 Drawing Sheets

AUTOMATICALLY SPREADING AND COLLAPSING UMBRELLA

BACKGROUND OF THE INVENTION

1. Field of the Invention

This invention relates to an automatic umbrella, more particularly to an automatically spreading and collapsing umbrella which can be quickly collapsed with the aid of a collapsing tension spring and a resilient wire.

2. Description of the Related Art

Referring to FIG. 1, a conventional automatically spreading and collapsing umbrella is shown to include an elongate handle 10 with an upper end, a lower end and a middle portion therebetween, a ferrule 20 which is fixed on the upper end of the handle 10 for mounting a canopy 60, a tubular runner 30 which is sleeved slidably on the middle portion of the handle 10, a plurality of rib assemblies (only one is shown) which are disposed at an underside of the canopy 60 to support the canopy 60 in a spread-out position and in a collapsed position, and a plurality of stretcher assemblies (only one is shown) which interconnect the rib assemblies and the runner 30 so as to permit stretching and retracting of the rib assemblies in order to disposed the canopy 60 in a selected one of the spread-out position and the collapsed position when the runner 30 is moved along the handle 10. Each rib assembly includes a main rib 41, a top rib 42 and an extending rib 43. Each stretcher assembly includes a stretcher 44 which is pivotally connected to the runner 30 and the main rib 41, and a connecting rod 45 which has one end pivotally connected to the stretcher 44 and the other end formed with a sliding slot 451 (see FIG. 4) for sliding engagement with the top rib 42 by means of a pivot pin 421.

For automatically collapsing the rib assembly, a collapsing tension spring 50 and a resilient wire 46 are disposed between the rib assembly and the stretcher assembly. With reference to FIGS. 2 and 3, the resilient wire 46 is formed with a straight wire portion 461 at one end thereof. The straight wire portion 461 passes transversely through the main rib 41 for engagement with one end of the tension spring 50. The other ends of the resilient wire 46 and the tension spring 50 are respectively connected to an engaging hole 452 (see FIG. 4) in the extending rib 43 and the connecting rod 45. As such, stretching of the rib assemblies will extend the tension spring 50 to store an elastic potential energy for restoring the tension spring 50 to facilitate collapsing of the rib assemblies. At the same time, the resilient wire 46 can actuate the extending rib 43 to retract inwardly toward the top rib 42.

However, the collapsing operation of the rib assemblies of the conventional umbrella is not smooth, and a lateral force is needed to be applied on the rib assemblies. As shown in FIG. 4, when the rib assembly is stretched, the extending lengths of the connecting rod 45 and the tension spring 50 are almost parallel to each other. That is, a collapsing angle ($\gamma$) is defined between reference lines (A) and (B). The reference line (A) is defined by the extension from the engaging hole 452 via the pivot pin 421. The reference line (B) is defined by the extension of the tension spring 50. The greater is the collapsing angle ($\gamma$), the easier will be the collapsing operation of the rib assemblies. The collapsing angle ($\gamma$) is very small in the conventional umbrella, thereby resulting in adverse affect to the collapsing operation of the tension spring 50.

SUMMARY OF THE INVENTION

The object of the present invention is to provide an automatically spreading and collapsing umbrella which can overcome the aforementioned problem of the conventional umbrella and which can be quickly and easily collapsed.

According to this invention, an automatically spreading and collapsing umbrella includes a canopy which is supported in a spread-out position and a collapsed position by a plurality of rib assemblies. The rib assemblies are connected to a runner by a plurality of stretcher assemblies so as to permit stretching and retracting of the rib assemblies in order to dispose the canopy in the selected one of the spread-out position and the collapsed position when the runner is moved along a handle.

Each rib assembly includes a main rib, a top rib, and an extending rib. The main rib has an elongate top wall, and two opposite side walls which extend downwardly from two elongate edges of the top wall and which have a proximate end pivotally connected to the ferrule, a distal end opposite to the proximate end and having a first pivot, and a second pivot spaced from the first pivot between the proximate and distal ends. The top rib is pivotally connected to the second pivot, and has proximate and distal ends opposite to each other relative to the second pivot. The proximate end of the top rib has a third pivot. The extending rib is pivotally connected to the distal end of the top rib.

Each stretcher assembly includes a stretcher and a connecting rod. The stretcher is pivotally connected to the runner and the second pivot at two ends, and has a fourth pivot near the second pivot. The connecting rod is pivotally connected to the third and fourth pivots.

An anchored member has two journalled ends journalled respectively on the side walls of the main rib of one of the rib assemblies between the first and second pivots, and a middle portion between the journalled ends. The middle portion has an anchored site which is formed as a bent strip that is vaulted toward the top wall.

A collapsing tension spring is retained on the connecting rod and the anchored site so as to define a collapsing line along an extending length of the collapsing tension spring. As such, stretching of the rib assemblies will extend the tension spring to store an elastic potential energy for restoring the tension spring to facilitate collapsing the rib assemblies.

A resilient wire is connected to and is integrally formed with one of the journalled ends of the anchored member at one end, and is connected to the extending rib of one of the rib assemblies at the other end so as to actuate the extending rib to retract inwardly toward the top rib when the rib assemblies are collapsed.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
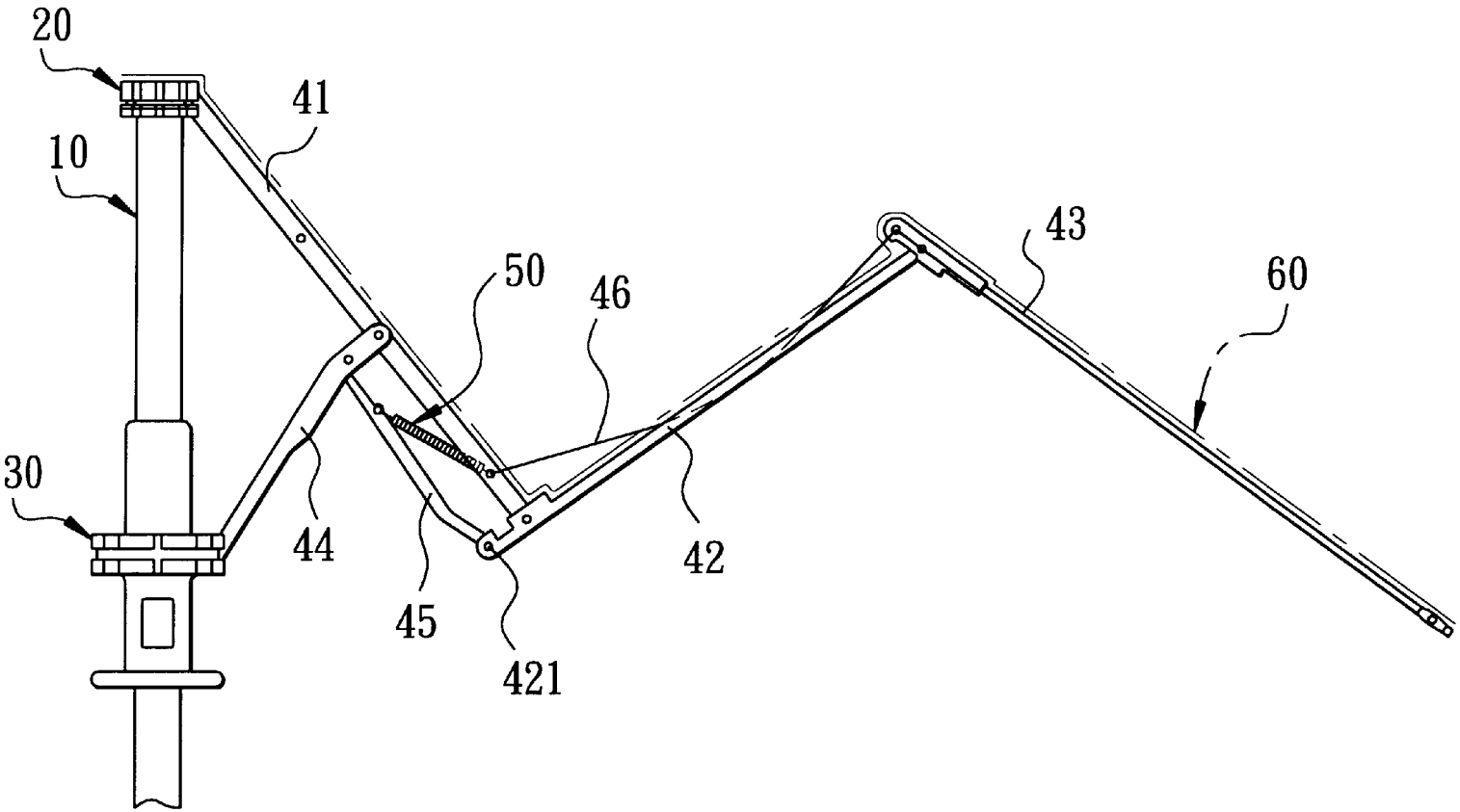
FIG. 1 PRIOR ART
FIG. 1 is a schematic view of a portion of a conventional automatic umbrella.
Figure 2:
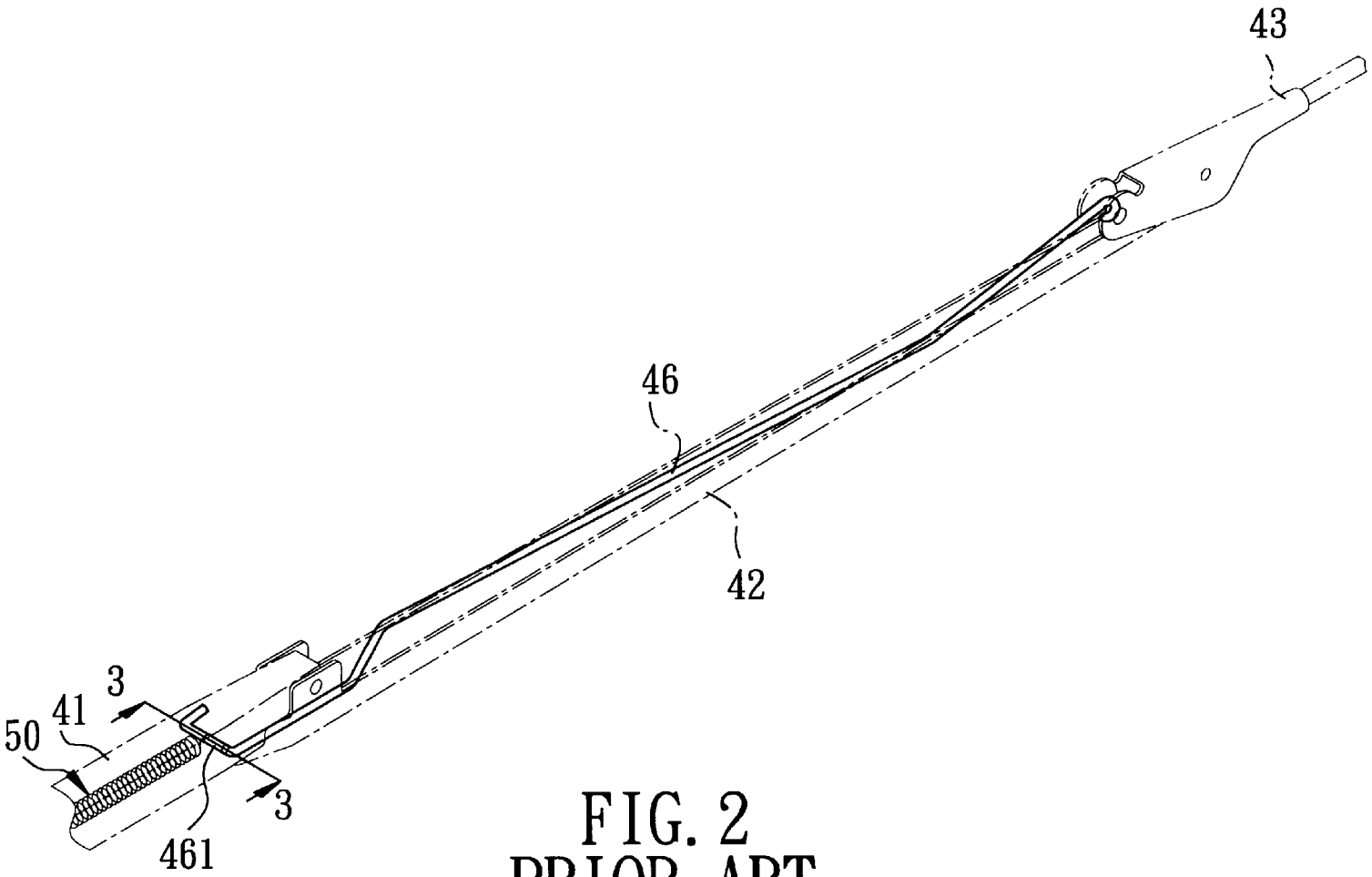
FIG. 2 PRIOR ART
FIG. 2 is a perspective view showing a resilient wire and a collapsing tension spring of the conventional automatic umbrella.
Figure 3:
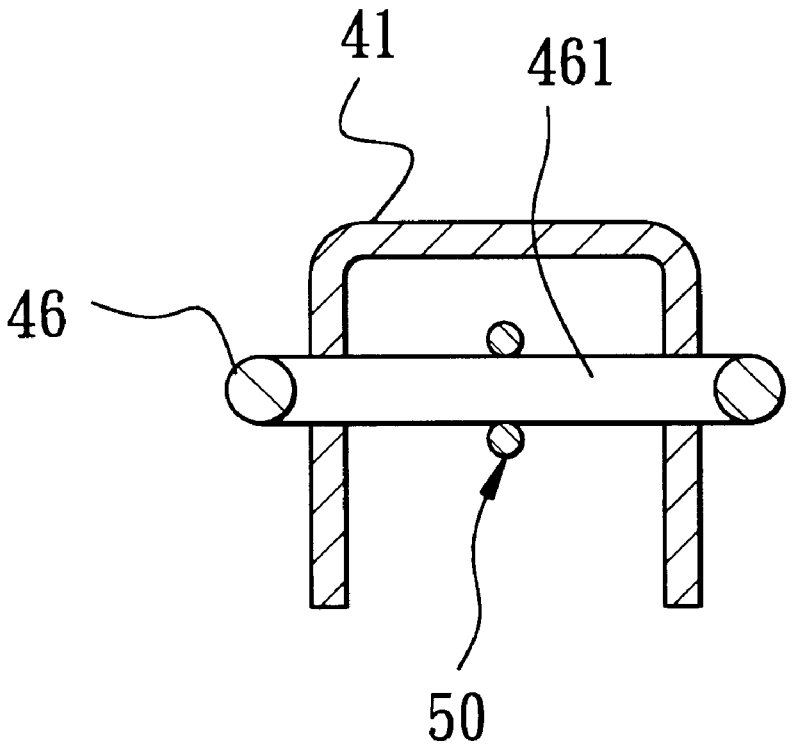
FIG. 3 PRIOR ART
FIG. 3 is a sectional view of an anchored member of the automatic umbrella shown in FIG. 2, taken along lines 3—3 thereof.
Figure 4:
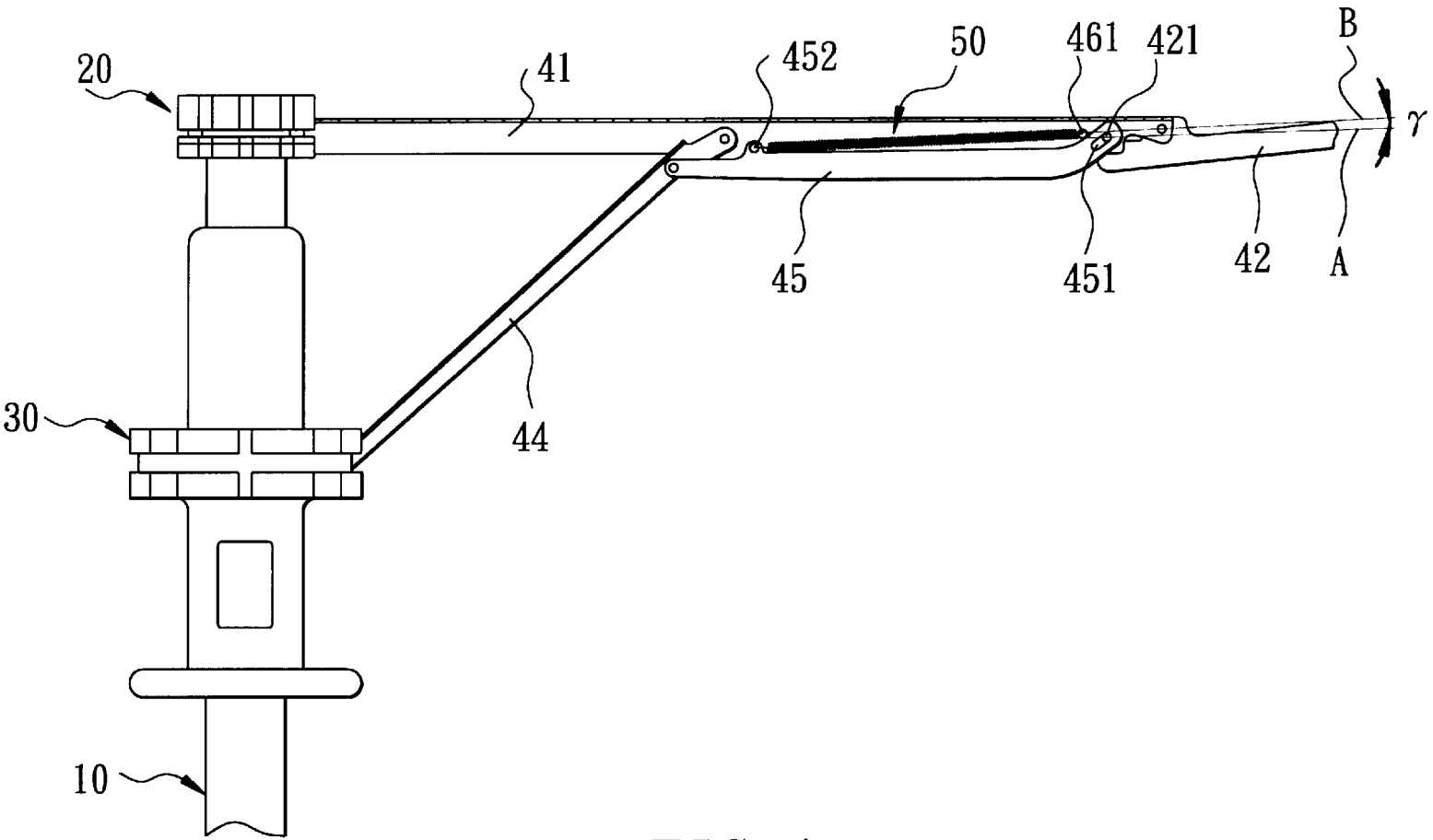
FIG. 4 PRIOR ART
FIG. 4 is a perspective view of the conventional automatic umbrella in a stretched state.

Before the present invention is described in greater detail, it should be noted that same reference numerals have been used to denote like elements throughout the specification.

Figure 5:
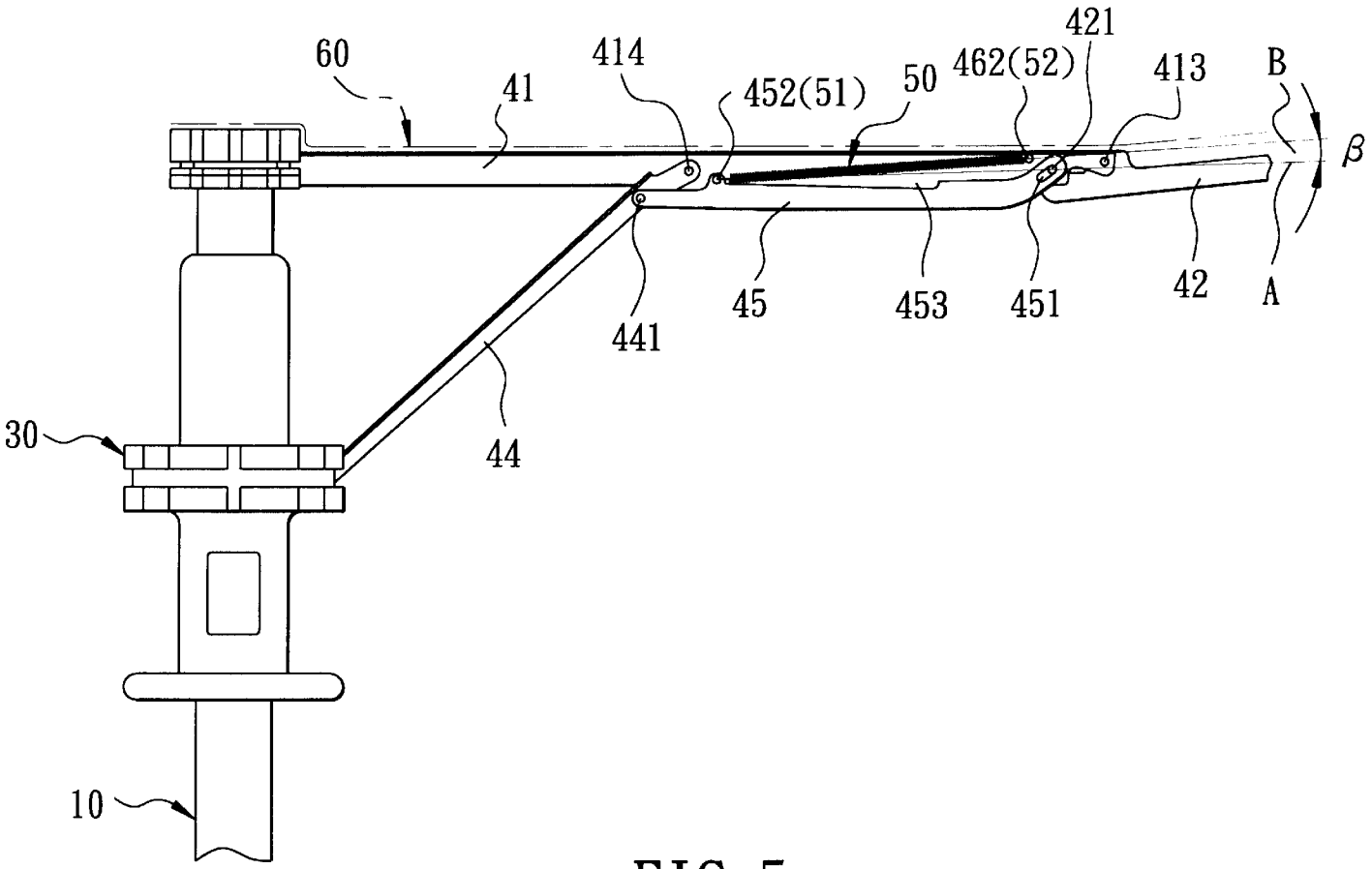
FIG. 5 is a schematic view of a portion of a preferred embodiment of an automatically spreading and collapsing umbrella according to this invention in a stretched state.
Figure 6:
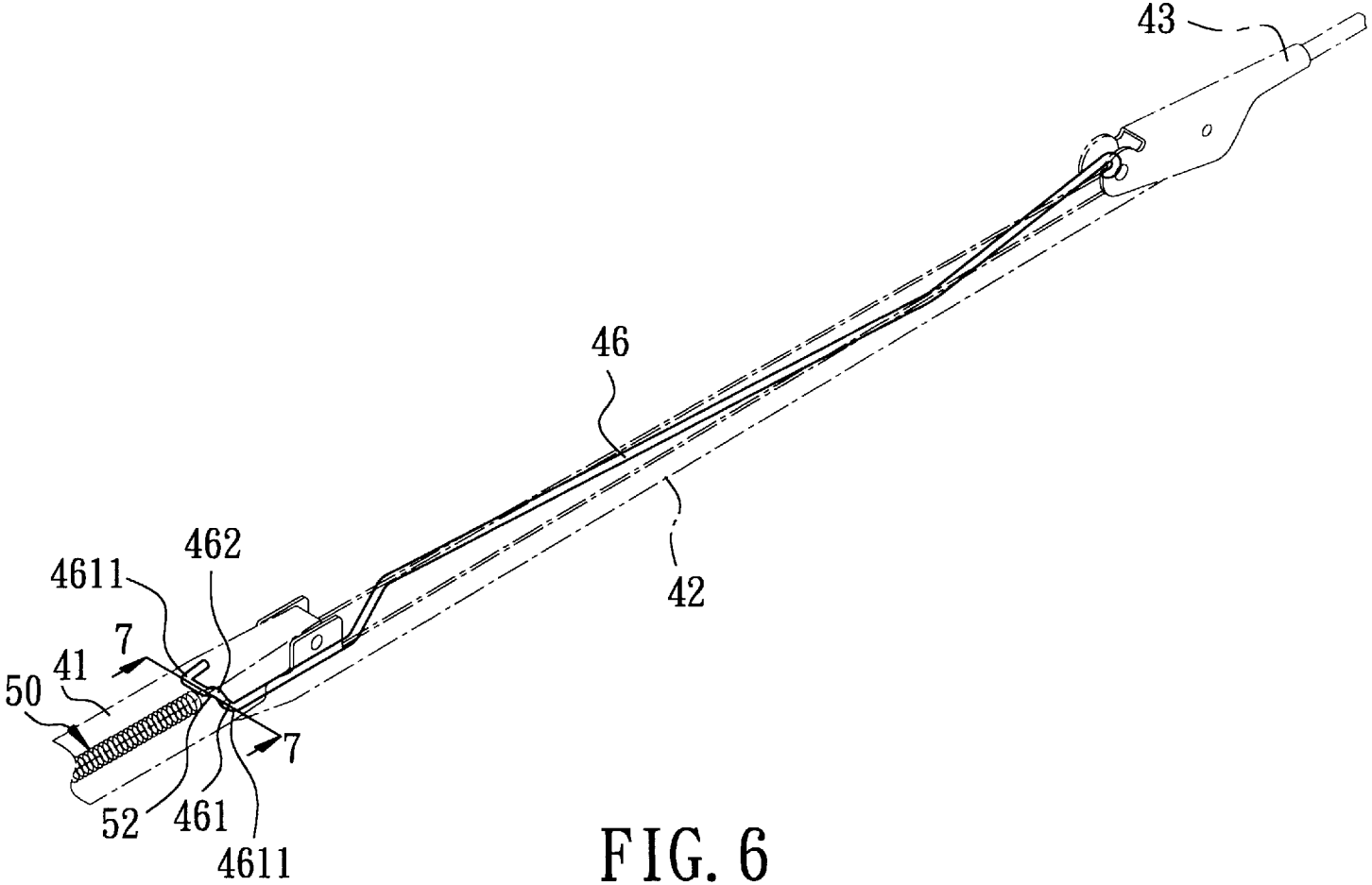
FIG. 6 is a perspective view showing a collapsing tension spring and a resilient wire for collapsing the umbrella according to the preferred embodiment.
Figure 7:
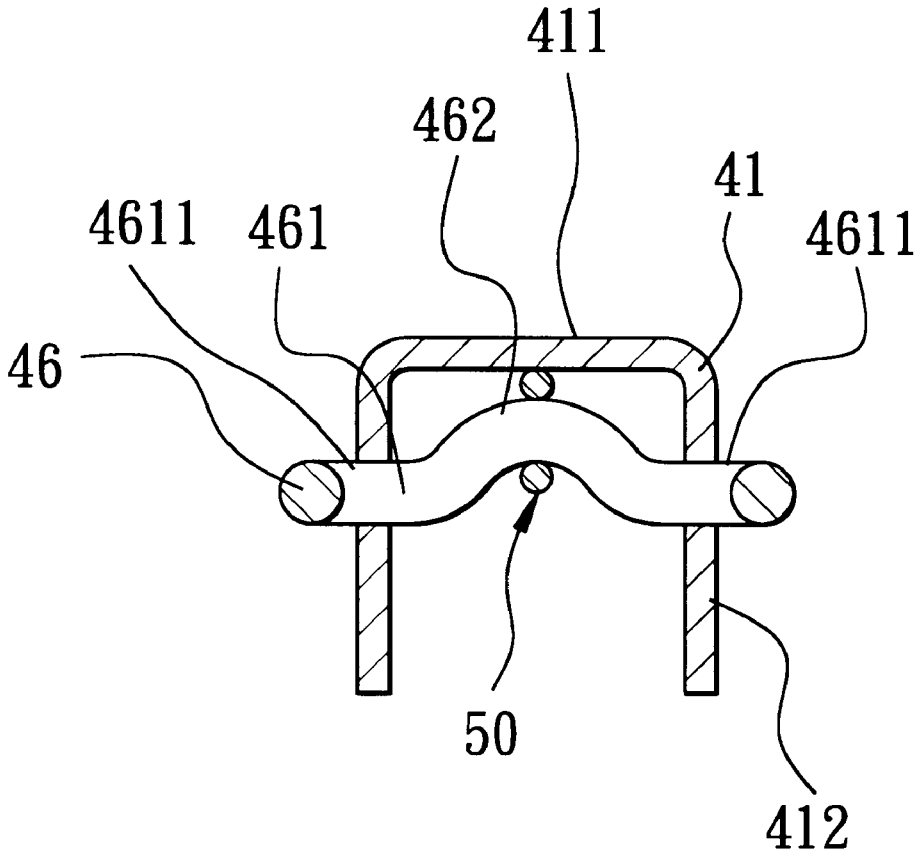
FIG. 7 is a sectional view of an anchored member of the umbrella shown in FIG. 6, taken along lines 7—7 thereof.

Referring to FIGS. 5, 6 and 7, the preferred embodiment of the automatically spreading and collapsing umbrella according to the present invention is shown to have a construction similar to that of the conventional umbrella shown in FIGS. 1 to 4. The canopy 60 is supported in a spread-out position and a collapsed position by a plurality of rib assemblies (only one is shown), and the rib assemblies are connected to the runner 30 by a plurality of stretcher assemblies (only one is shown) so as to permit stretching and retracting of the rib assemblies in order to dispose the canopy 60 in a selected one of the spread-out position and the collapsed position when the runner 30 is moved along the handle 10.

Each rib assembly includes a main rib 41, a top rib 42, and an extending rib 43. The main rib 41 has an elongate top wall 411, and two opposite side walls 412 which extend downwardly from two elongate edges of the top wall 411 and which have a proximate end pivotally connected to the ferrule 20, a distal end opposite to the proximate end and having a first pivot 413, and a second pivot 414 spaced from the first pivot 413 between the proximate and distal ends. The top rib 42 is pivotally connected to the first pivot 413, and has proximate and distal ends opposite to each other relative to the first pivot 413. The proximate end of the top rib 42 has a third pivot 421. The extending rib 43 is pivotally connected to the distal end of the top rib 42.

Each stretcher assembly includes a stretcher 44 and a connecting rod 45. The stretcher 44 has proximate and distal ends which are respectively and pivotally connected to the runner 30 and the second pivot 414 of the main rib 41, and a fourth pivot 441 between the proximate and distal ends and near the second pivot 414. The connecting rod 45 has a proximate end which is pivotally connected to the fourth pivot 441, and an opposite distal end which is formed with a sliding slot 451 for slidably engaging the third pivot 421. As such, the first, second, third and fourth pivots 413,414, 421,441 define four connecting sections which are connected to one another at two of the pivots. Moreover, an engaging hole 452 is formed in the connecting rod 45 near the fourth pivot 441.

An anchored member 461 has two journalled ends 4611 which are journalled respectively on the side walls 412 of the main rib 41 of one of the rib assemblies at the connecting section between the first and second pivots 413,414, and a middle portion which is interposed between the journalled ends 4611. The middle portion has an anchored site 462 which is formed as a bent strip, such as by bending a wire, that is vaulted toward the top wall 411.

A collapsing tension spring 50 has two ends 51,52 which are respectively retained on the engaging hole 452 of the connecting rod 45 and the anchored site 462 of the anchored member 46 so as to define a collapsing line along an extending length of the collapsing tension spring 50. Thus, stretching of the rib assemblies will extend the tension spring 50 to store an elastic potential energy in the tension spring 50 for restoring the tension spring 50 to facilitate collapsing of the rib assemblies.

A resilient wire 46 has one end which is connected to and integrally formed with one of the journalled ends 4611 of the anchored member 461, and an opposite end which is connected to the extending rib 43 so as to actuate the extending rib 43 of one of the rib assemblies to retract inwardly toward the top rib 42 when the rib assemblies are collapsed.

As shown in FIG. 5, a collapsing angle (β) is defined between reference lines (A) and (B). The reference line (A) is defined by the extension from the engaging hole 452 via the third pivot 421. The reference line (B) is defined by the extending length of the tension spring 50. With the presence of the anchored site 462 which is vaulted toward the top wall 411, the collapsing angle (β) can be increased so as to facilitate collapsing of the rib assemblies.

Figure 8:
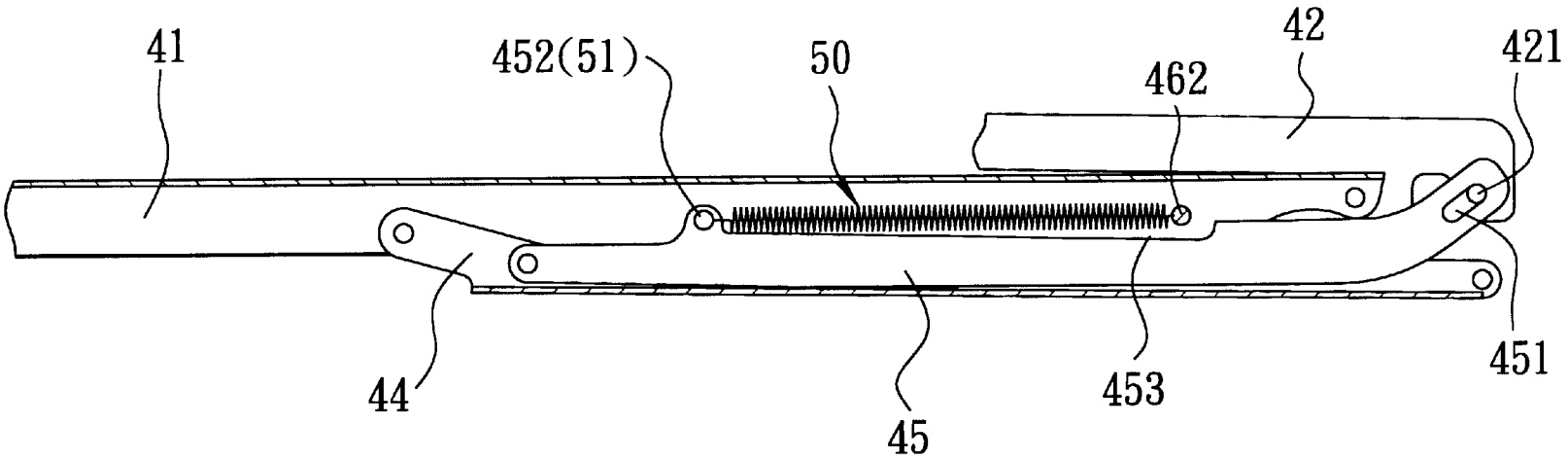
FIG. 8 is a sectional view of the umbrella according to the preferred embodiment in a collapsed state.

Moreover, referring to FIG. 8, the connecting rod 45 further has a recess 453 which extends downwardly so as to prevent the tension spring 50 and the anchoring member 461 from interfering with the connecting rod 45 when the rib assemblies are collapsed.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. An automatically spreading and collapsing umbrella, comprising:

an elongate handle having an upper end, a lower end and a middle portion therebetween;

a ferrule fixed on said upper end of said handle;

a canopy mounted on said ferrule;

a tubular runner sleeved slidably on said middle portion of said handle;

a plurality of rib assemblies disposed at an underside of said canopy to support said canopy in a spread-out position and in a collapsed position, each of said rib assemblies including:

a main rib having an elongate top wall, and two opposite side walls extending downwardly from two elongate edges of said top wall and having a proximate end pivotally connected to said ferrule, a distal end opposite to said proximate end and having a first pivot, and a second pivot spaced from said first pivot and adjacent to said distal end;

a top rib pivotally connected to said first pivot, and having proximate and distal ends opposite to each other relative to said second pivot, said proximate end of said top rib having a third pivot; and an extending rib pivotally connected to said distal end of said top rib;

a plurality of stretcher assemblies, each disposed to interconnect a respective one of said rib assemblies and said runner so as to permit stretching and retracting of said respective one of said rib assemblies in order to dispose said canopy in a selected one of said spread-out position and said collapsed position when said runner is moved along said handle, each of said stretcher assemblies including:

a stretcher having proximate and distal ends respectively and pivotally connected to said runner and said second pivot of said main rib, and a fourth pivot between said proximate and distal ends and near said second pivot; and a connecting rod pivotally connected to said third and fourth pivots such that said first, second, third and fourth pivots define four connecting sections connected to one another at two of said pivots, wherein said first and second pivots define a first connecting section;

an anchored member having two journalled ends journalled respectively on said side walls of said main rib of one of said rib assemblies at said first connecting section, and a middle portion interposed between said journalled ends, said middle portion having an anchored site which is formed as a bent strip that is vaulted toward said top wall;

a collapsing tension spring having two ends respectively retained on said connecting rod and said anchored site of said anchored member so as to define a collapsing line along an extending length of said collapsing tension spring, such that stretching of said rib assemblies will extend said tension spring to store an elastic potential energy in said tension spring for restoring said tension spring to facilitate collapsing of said rib assemblies; and a resilient wire having an end connected to and integrally formed with one of said journalled ends of said anchored member, and an opposite end connected to said extending rib of said one of said rib assemblies so as to actuate said extending rib to retract inwardly toward said top rib when said rib assemblies are collapsed.

2. The umbrella as claimed in claim 1, wherein said connecting rod further has a recess extending downwardly so as to prevent said tension spring and said anchored member from interfering with said connecting rod when said rib assemblies are collapsed.

* * * * *